US008607688B2

(12) United States Patent
Cassels

(10) Patent No.: US 8,607,688 B2
(45) Date of Patent: Dec. 17, 2013

(54) MULTI-BLOCK GAS REGULATOR

(76) Inventor: Charles B Cassels, New Smyrna Beach, FL (US)

( * ) Notice: Subject to any disclaimer, the term of this patent is extended or adjusted under 35 U.S.C. 154(b) by 97 days.

(21) Appl. No.: 13/223,985

(22) Filed: Sep. 1, 2011

(65) Prior Publication Data

US 2013/0055883 A1 Mar. 7, 2013

(51) Int. Cl.
*F41A 5/00* (2006.01)

(52) U.S. Cl.
USPC ..... 89/193; 89/191.01

(58) Field of Classification Search
USPC ..... 89/193
See application file for complete search history.

(56) References Cited

U.S. PATENT DOCUMENTS

| | | | | |
|---|---|---|---|---|
| 7,461,581 | B2 * | 12/2008 | Leitner-Wise | 89/191.01 |
| 7,610,844 | B2 * | 11/2009 | Kuczynko et al. | 89/193 |
| 7,739,939 | B2 * | 6/2010 | Adams | 89/191.01 |
| 7,856,917 | B2 | 12/2010 | Noveske | |
| 7,934,447 | B2 * | 5/2011 | Kuczynko et al. | 89/193 |
| 7,971,518 | B2 * | 7/2011 | Adams | 89/191.01 |
| 8,161,864 | B1 | 4/2012 | Vuksanovich | |
| 8,210,089 | B2 | 7/2012 | Brown | |
| 2003/0121444 | A1 * | 7/2003 | Mutascio et al. | 102/431 |
| 2010/0095834 | A1 * | 4/2010 | Kuczynko et al. | 89/193 |
| 2010/0199836 | A1 * | 8/2010 | Herring | 89/193 |

* cited by examiner

*Primary Examiner* — Samir Abdosh
(74) *Attorney, Agent, or Firm* — Carter, DeLuca, Farrell & Schmidt, LLP

(57) ABSTRACT

A multi use retro fit capable adjustable gas block designed to interface with an autoloading gas operated firearm is provided to replace existing gas blocks. The adjustable gas block optimizes gas flow into the host firearms operating system. The adjustable gas block has a spring loaded adjustment knob that releases when pulled forward allowing it to rotate. By rotating the adjustment knob the gas flow is increased or decreased based on one of four provided gas settings. Setting one is optimal for using a silencer, setting two is optimal for normal operations, setting three is optimal for adverse conditions, and setting four either turns the gas flow off optimizing sound reduction and providing for manual operation, or provides an extra high gas setting for the host firearm. The system works by precisely metering gas entering the operating system and not by exhausting excess gas into the atmosphere. The adjustable gas regulator may be configured with a piston operating system or a direct gas impingement operating system, e.g. gas tube, as is the case with the standard AR-15/AR-10 family of firearms.

18 Claims, 8 Drawing Sheets

MULTI-BLOCK GAS REGULATOR

BACKGROUND

1. Technical Field

The present disclosure relates generally to self loading firearms and, more particularly, to a multi-block gas regulator for use with self-loading firearms 2. Description of the Related Art Adjustable gas regulators have been utilized on self loading firearms since the 1940's. Some early examples are the Soviet SVD and Belgium FAL, while the Adams Arms, Sig Sauer 516 and the Ruger SR-556 are some recent designs.

Early on gas regulators were developed to enable discharge gas pressure to be adjusted on a host firearm. The use of gas regulators was necessitated by ammunition that produced inconsistent pressures that led to excessive wear and or malfunctions of a firearm's operating system.

More recently with the increased use of silencers, the role of gas regulators took on a new priority in the form of managing back pressure. Back pressure is created by a silencer forcing more discharge gas into the rifles operating system. The increase in the volume of discharge gas passing through the operating system of a firearm resulted in increased fouling, felt recoil, accelerated wear of the firearms components and a plethora of operational related malfunctions.

With the early designs like the Belgian FAL, the discharge gas was regulated by allowing excess gas to be exhausted into the atmosphere. However, such regulation was not practical with firearms utilizing a silencer because when the discharge gas entered the oxygen rich atmosphere, the gases flashed and produced a report that nullified the silencing effect of the silencer. Furthermore, the regulator did not provide preset gas settings. Other disadvantages of such systems included requiring a tool to adjust the gas settings and the inability to rapidly adjust the gas flow while the weapon is fielded.

Modern designs like Adams Arms have made some improvements over earlier designs in the following ways: 1) restricting the amount of discharge gas allowed to escape into the atmosphere. 2) equipping their regulators with preset gas adjustments; and 3) providing a means to change gas settings in the field without requiring the use of tools.

The problems with existing systems are numerous. Adams Arms is the only current retro fit piston system that is capable of regulating gas flow to the firearms operating system. However the Adams Arms system is not equipped to precisely regulate gas as would be appropriate to optimize a firearm's performance. Furthermore, the Adams Arms gas regulation system is limited to three positions, i.e., partial gas, full gas, and off. Because the system uses a single large aperture for full gas and partially occludes the aperture to achieve partial gas, the caliber and type of ammunition compatibility are unduly restricted. The Adams Arms single aperture design lacks efficiency by excluding a means to precisely meter gas flow. The gas regulator is not easily manipulated under adverse conditions, especially if gloves are worn. In addition, the gas regulator can be accidentally released while moving between settings and there are no options for a low profile gas regulator that would allow the use of an uninterrupted extended hand guard.

The present disclosure offers many advantages over the prior art. More specifically, the presently disclosed gas regulator provides four positions of adjustment including reduced gas flow, normal gas flow, adverse gas flow, and extra high or no gas flow settings. Each position of adjustment has a precisely sized gas port to optimize performance with or without a silencer and provide the widest range of caliber and ammunition type compatibility. A spring loaded adjustment knob positively locks the regulator in position while its method of actuation and size facilitate rapid manipulation under adverse conditions and while wearing gloves. The gas regulator works by restricting the flow of gas from the host weapons barrel and not by venting excess gas into the atmosphere. The present disclosure offers an alternative low profile gas regulator that may be concealed under the hand guard providing for an uninterrupted extended hand guard for mounting accessories, In addition, the gas regulator cannot be accidentally released while in use yet it can be easily retro fitted to existing gas operated firearms. Moreover, the gas regulator may be quickly and easily disassembled for routine maintenance, and can be configured for use with both indirect gas impingement, e.g. piston op-rod, or direct gas impingement, e.g. original AR type, operating systems.

SUMMARY

An adjustable gas regulator for use with a gas operated firearm is disclosed which includes a gas block configured to receive a barrel of a firearm and defining a gas block bore. A gas port is defined within the gas block bore and is positioned to communicate with a gas port aperture of a firearm. A gas regulating cylinder is dimensioned to be rotatably received within the gas block bore. The gas regulating cylinder defines a plurality of cylinder gas ports spaced about the periphery of the cylinder. The gas regulating cylinder is rotatably positioned within the gas block such that the gas regulating cylinder is selectively rotatable to position any one of the cylinder gas ports in communication with the gas port of the gas block bore. In one embodiment, an adjustment knob is secured to one end of the gas regulating cylinder. The adjustment knob is rotatably fixed in relation to the gas regulating cylinder such that rotation of the adjustment knob effects corresponding rotation of the gas regulating cylinder.

In one embodiment, the adjustment knob includes interlocking structure configured to releasably retain the adjustment knob in a plurality of rotatably fixed positions in relation to the gas block. The adjustment knob may include at least one position stop and the gas block may support structure defining a plurality of notches dimensioned to receive the at least one position stop to rotatably maintain the adjustment knob and the gas regulating cylinder in rotatably fixed positions with respect to the gas block. In one embodiment, the adjustment knob is movable axially from a first position wherein the at least one position stop is received in at least one of the plurality of notches to a second position wherein the at least one position stop is disengaged from the at least one of the plurality of notches, wherein in the second position of the adjustment knob, the adjustment knob and the gas regulating cylinder are rotatable in relation to the gas block. A spring may be positioned to urge the adjustment knob to the first position.

In one embodiment, a bushing is fixedly positioned within the gas block bore and the plurality of notches are formed in one end of the bushing.

In an alternate embodiment, the plurality of notches are formed in one end of the gas block.

The plurality of notches may include four notches and the at least one position stop may include two position stops. Each of the plurality of notches may be spaced 90 degrees from an adjacent notch about its periphery of the gas block or bushing.

In one embodiment, the gas block is a Picatinny-type gas block. Alternately, the gas block may be a low profile gas block.

BRIEF DESCRIPTION OF THE DRAWINGS

Various embodiments of the presently disclosed multi-block gas regulator are disclosed herein with reference to the drawings wherein.

DETAILED DESCRIPTION OF EMBODIMENTS

Figure 1:
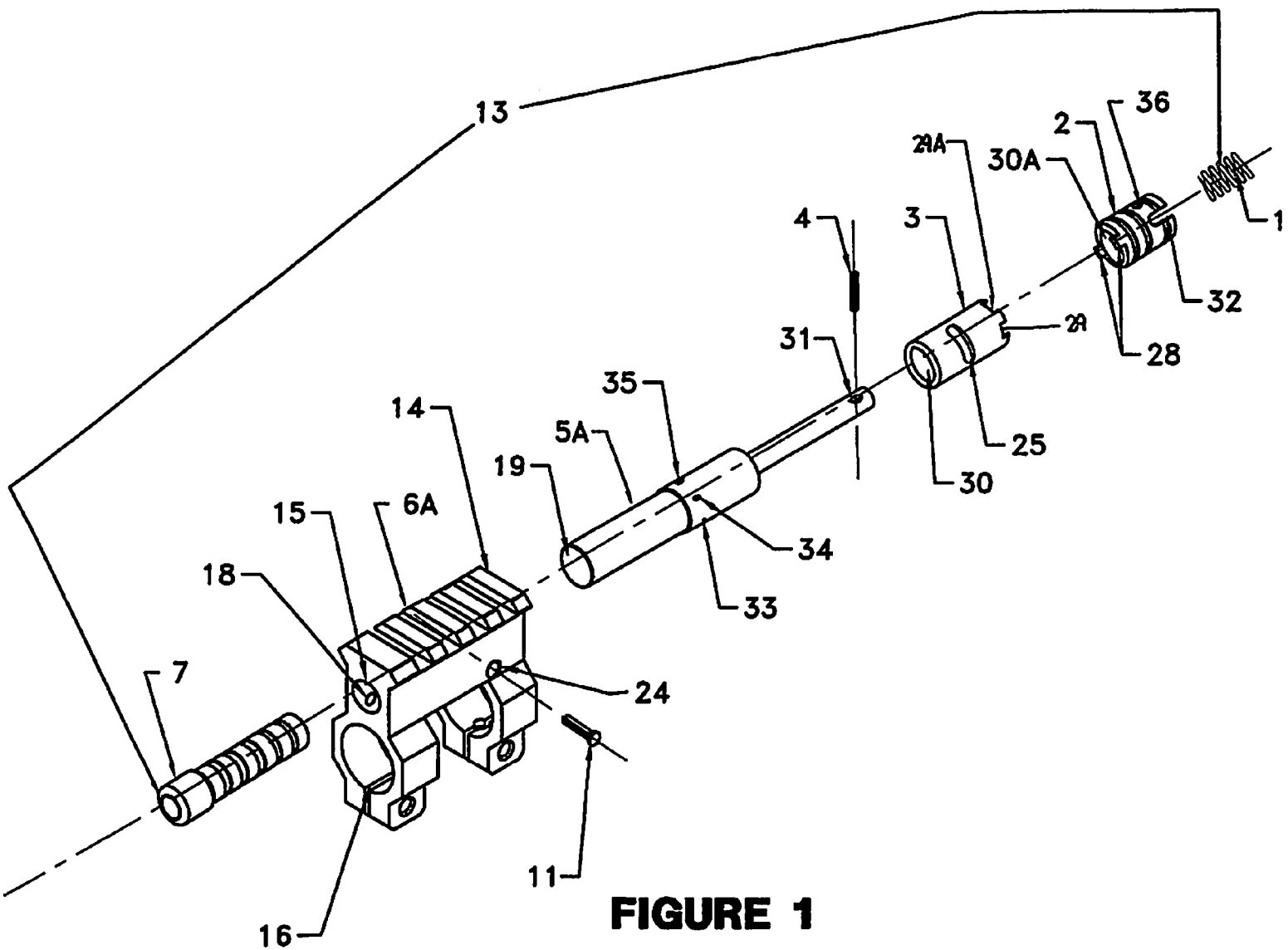
FIG. 1 is an exploded view in perspective of the presently disclosed multi-block gas regulator including with a Picatinny rail type gas block, and removable four position gas regulating cylinder.

Embodiments of the presently disclosed multi-block gas regulator will now be described in detail with reference to the drawings wherein like reference numerals designate identical or corresponding elements in each of the several views.

The detailed description set forth below in connection with the appended drawings is intended as a description of selected embodiments of the disclosure and is not intended to represent the only forms in which the present embodiments may be constructed and/or utilized. The description sets forth the functions and the sequence of steps for constructing and operating the selected embodiments. However, it is to be understood that the same or equivalent functions and sequences may be accomplished by different embodiments that are also intended to be encompassed within the spirit and scope of this disclosure.

Figure 3:
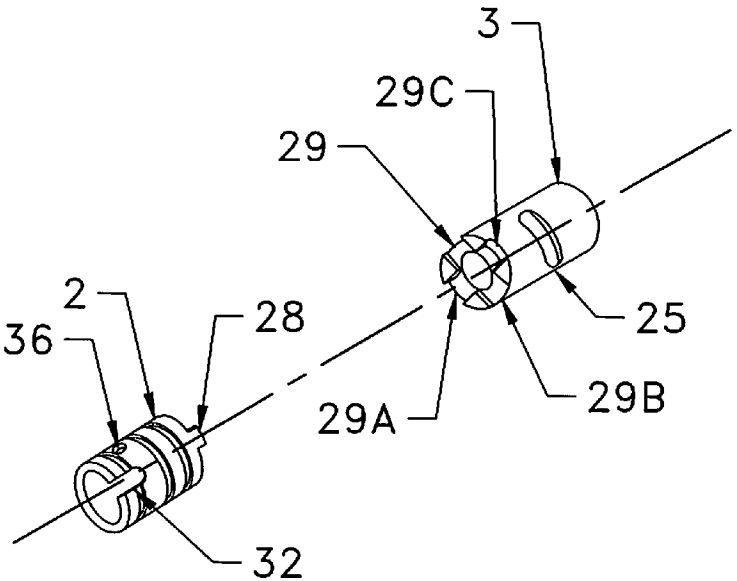
FIG. 3 is a perspective view from the front of the bushing and adjustment knob of the multi-block gas regulator shown in FIG. 1.
Figure 4A:
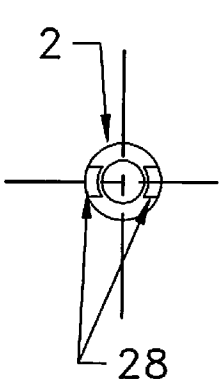
FIG. 4A is a front view of the adjustment knob shown in FIG. 4.
Figure 4B:
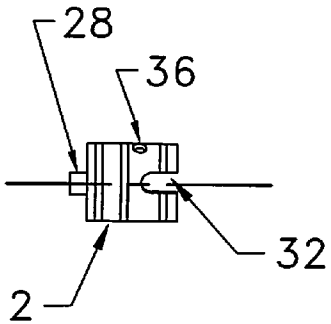
FIG. 4B is a side view of the adjustment knob of FIG. 4.
Figure 4:
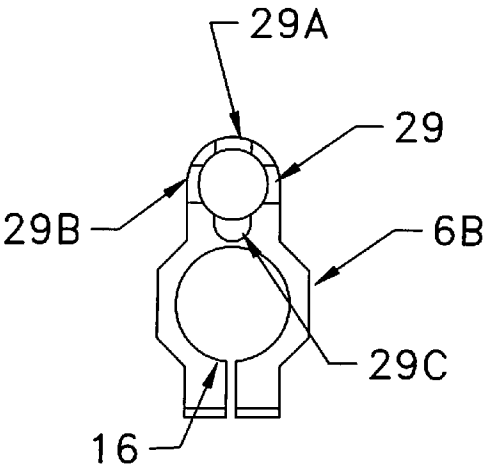
FIG. 4 is a front view of low profile gas block and the adjustment knob of the multi-block gas regular shown in FIG. 1.
Figure 5:
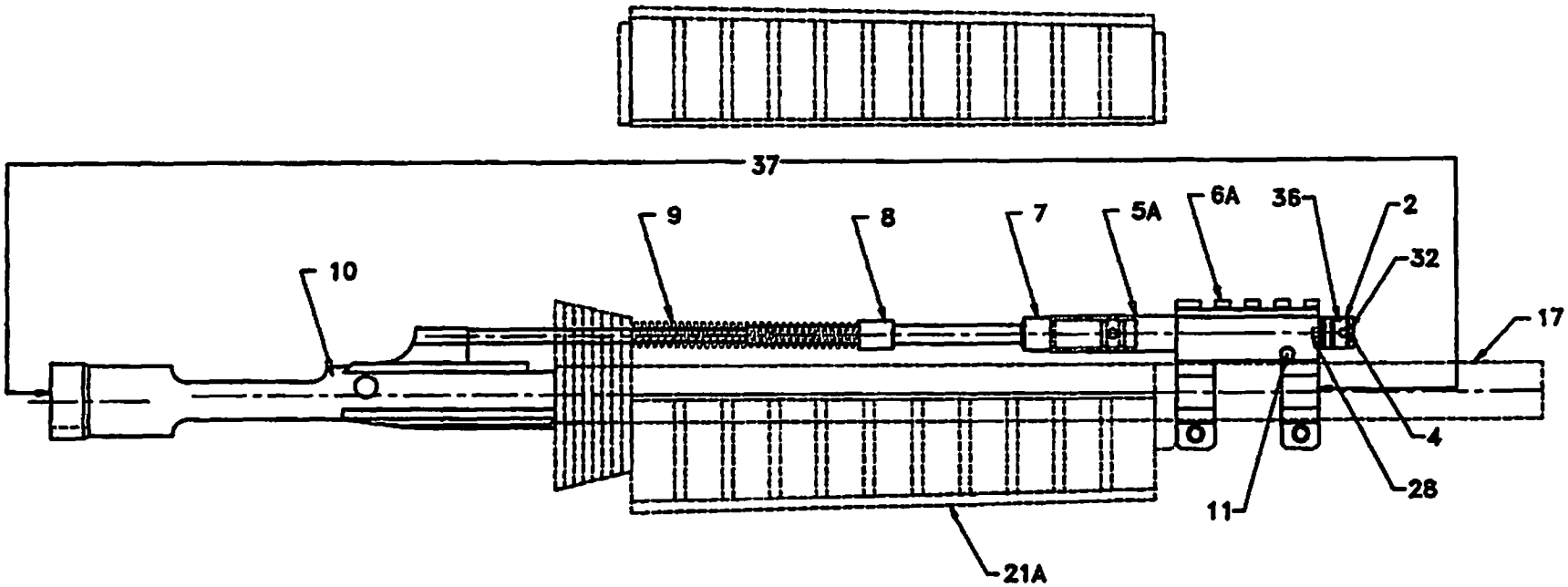
FIG. 5 is a side view of the multi-block gas regulator as shown in FIG. 1 in an assembled state as it would be installed on a firearm.

Exemplary embodiments of the present disclosure are shown in FIGS. 1-9. Looking first at FIGS. 1, 2, and 5, the multi-block gas regulator 13 is shown in an exploded view, with dashed lines indicating the order and way of assembly. The primary parts of the multi-block gas regulator 13 include a Picatinny-type gas block 6A, a gas regulating cylinder 5A, a bushing 3, an adjustment knob 2, a compression spring 1, a split pin 4, a piston 7, and a take down pin 11. In an alternative embodiment shown in FIG. 2, the gas block 6A can be replaced by a low profile gas block 6B which will be discussed in further detail herein below. The gas block 6A forms a rail mounting surface 14 on a top surface of gas block 6A for attaching accessories, e.g., sights, lasers, etc. Two bores extend through the gas block 6A including, a gas regulating cylinder bore 15 and a barrel bore 16. The gas regulating cylinder bore 15 is configured to receive the gas regulating cylinder 5A and the barrel bore 16 is configured to receive a barrel of a firearm 17 as shown in FIG. 5. The gas regulating cylinder 5A or 5B has a piston bore 19 which is configured to slidably receive a piston 7. FIG. 5 shows the multi-block gas regulator as it would be assembled on a firearm with additional parts including an op-rod (8), a return spring 9 and a bolt carrier 10.

Figure 2:
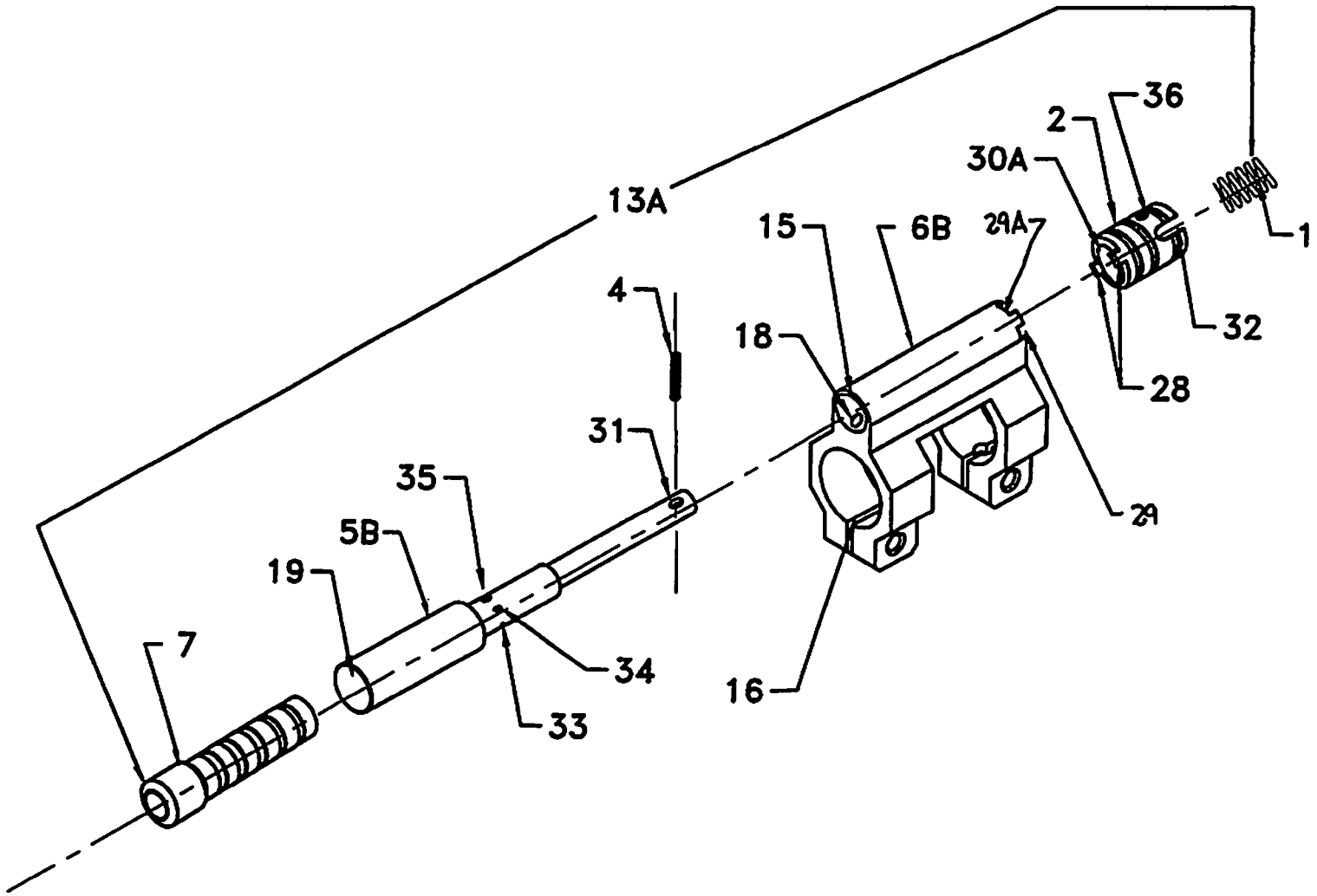
FIG. 2 is an exploded view in perspective of the presently disclosed multi-block gas regulator including a low profile gas block, and four position gas regulating cylinder.
Figure 7:
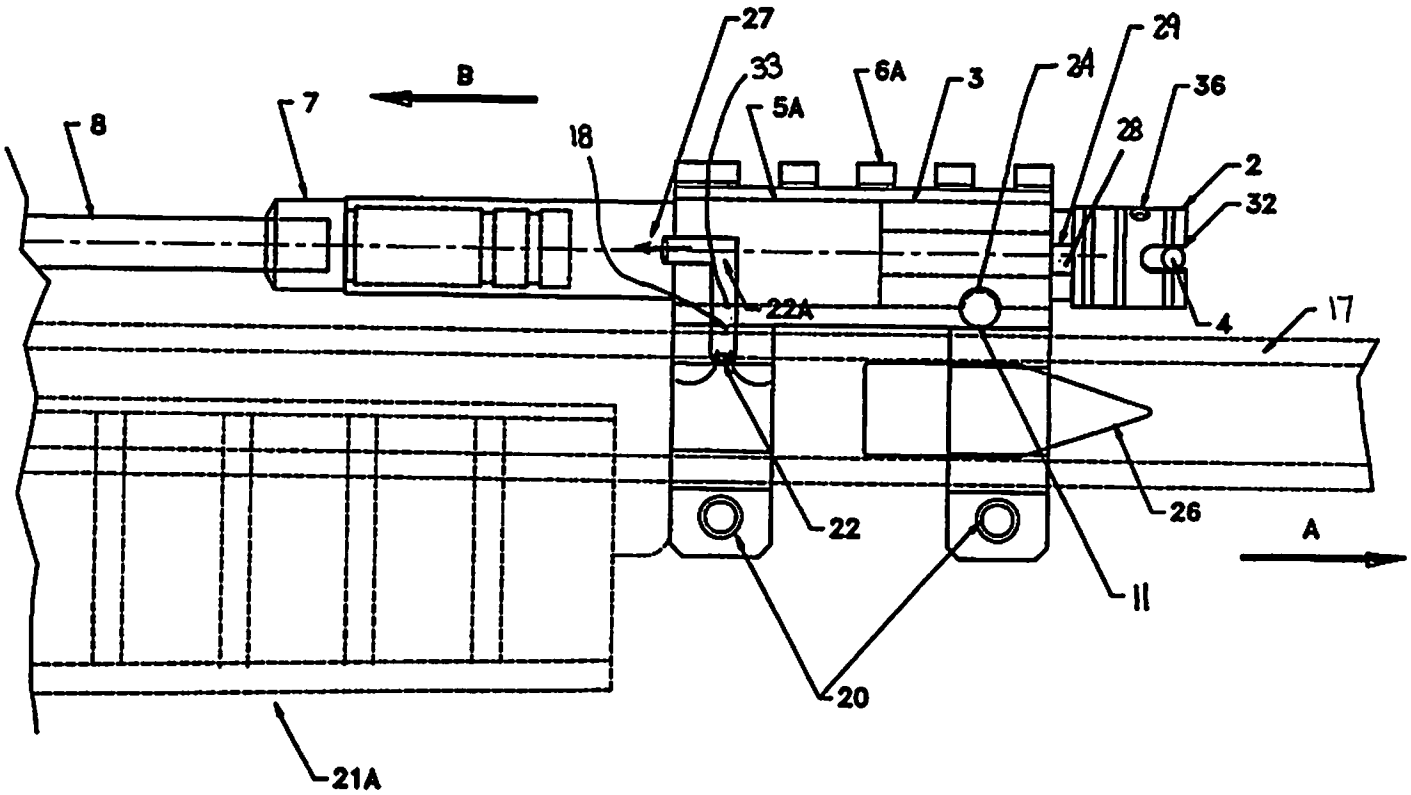
FIG. 7 is a side view of the fully assembled multi-block gas regulator illustrating internal details of the gas regulating system.

Referring to FIGS. 1, 2, and 7, a barrel 17 of a rifle defines a gas port aperture 22 which communicates with the gas block gas port 18) within gas regulating cylinder bore 15 of gas block 6A or 6B. Gas block gas port 18 communicates with the gas regulating cylinder 5A or 5B.

As discussed above, gas block 6A includes barrel bore 16 which is dimensioned to receive barrel 17 of a rifle. Clamping screws 20 are provided to fixedly secure gas block 6A to barrel 17. Referring also to FIG. 5, gas block 6A defines a retaining pin hole 24 which is aligned with a retaining pin groove 25 formed along bushing 3. A retaining pin 11 is dimensioned to be received through retaining pin hole 24 in gas block 6A and along retaining pin groove 25 in bushing 3 to secure bushing 3 in an axially and rotatably fixed position within gas block 6A. The regulating cylinder 5A is configured with three gas ports 33, 34, 35 of various sizes spaced apart, e.g., 90 degrees, about its periphery.

Bushing 3 and adjustment knob 2 are configured with a thru-bore 30 and 30A, respectively, to receive the narrow end of the regulating cylinder 5A. Bushing 3 has four index notches 29-29C (FIG. 4) positioned 90 degrees apart on its periphery. Index notches 29-29C are positioned to selectively interlock with position stops 28 that are positioned 180 degrees apart on the periphery of adjustment knob 2. Alternately, other configuration of stops and notches on knob 2 and bushing 3 may be provided to release secured knob 2 to bushing 3. Bushing 3 and adjustment knob 2 are secured to the regulating cylinder 5A with split pin 4. Split pin 4 traverses U-notches 32 of the adjustment knob 2 and is affixed within split pin bore 31. Adjustment knob 2 is maintained in interlocked relation with bushing 3 under compressive force of compression spring 1 which is captured between a shoulder or rim (not shown) defined at one end of adjustment knob 2 and split pin 4. Spring 1 urges adjustment knob 2 towards bushing 3 to position stops 28 in selected ones of notches 29-29C to rotatably secure knob 2 in relation to bushing 3. The adjustment knob 2 has a position aperture or indicator 36 that may be selectively aligned with any one of index notches 29-29C of bushing 3 to provide a visual indication of the selected gas setting of the multi-block gas regulator as will be described in further detail below.

As illustrated in FIG. 5, adjustment knob 2 is positioned forwardly of hand guard 21A and gas block 6A such that it is easily accessible to an operator. Because of the position of adjustment knob 2 and the type of interlocking engagement provided between adjustment knob 2 and, bushing 3, single handed manipulation or operation of adjustment knob 2 from either side of hand guard 21A, is easily effected.

Figure 6:
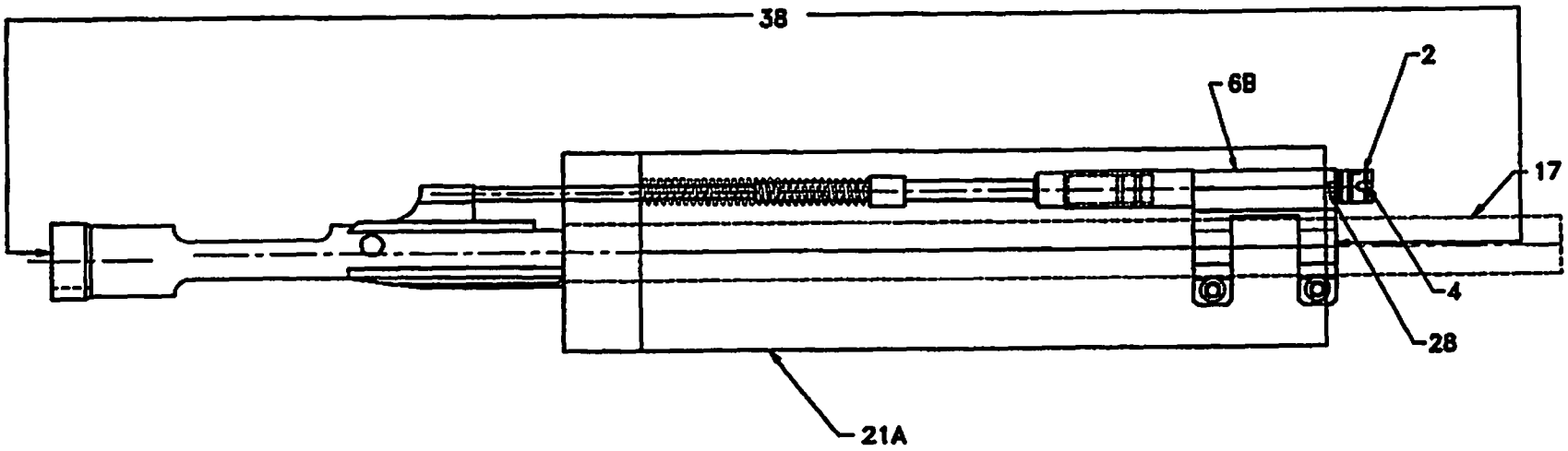
FIG. 6 is a side view of the multi-block gas regulator shown in FIG. 2 illustrating how the low profile gas block is fully concealed by the firearm's hand guard.

FIG. 6, is a side view of the multi-block gas regulator 13A shown in FIG. 2 illustrating the low profile gas block 6B fully concealed by the firearm's hand guard 21A. FIG. 6 also illustrates how the adjustment knob 2 is positioned forward of the hand guard 21A allowing easy access to the adjustment knob 2.

Referring to FIG. 7, when a round is fired, a bullet 26 is propelled by discharge gases 27 located behind bullet 26 muzzleward, in the direction indicated by arrow "A". When the bullet 26 passes over the gas port aperture 22 of barrel 17 of a firearm, a portion of the discharge gases 27 is directed through gas port aperture 22 and into the gas regulating cylinder passage 22A of gas block 6A. As the discharge gases 27 enter the gas regulating cylinder 5A, the gases exert a force that actuates a firearm's operating system. U.S. patent application Ser. No. 12/909,278 titled "Convertible Gas Piston Conversion System" discloses a gas operating system such as shown in FIG. 6 and is incorporated herein in its entirety by reference.

Referring to FIGS. 1, 3, and 7, gas flow into a firearm's operating system is traditionally set by the manufacturer and is determined by the size of the gas port aperture 22 created in the barrel 17 of the firearm. The multi-block gas regulator 13 of the present disclosure adjustably regulates the amount of gases permitted to flow into the firearm's operating system by selectively positioning one of gas ports 33-35 in communication with gas port aperture 22. More specifically, when adjustment knob 2 is rotated, split-pin 4, which is positioned through U-notches 32 of adjustment knob 2 and through split-pin bore 31 of regulating cylinder 5A, is also rotated to effect corresponding rotation of regulating cylinder 5A. Position aperture or indicator 36 is selectively positionable, by rotating adjustment knob 2, to be aligned with any one of index notches 29-29C. More specifically, when the adjustment knob 2 is positioned to align indicator 36 with index notch 29, regulating cylinder 5A is positioned to align gas port 33 in communication with gas port aperture 18 of gas block 6A which communicates with gas port aperture 22 of barrel 17 of a firearm. In one embodiment, gas port 33 is dimensioned to restrict the flow of discharge gas 27 to an optimum level to run a silencer. With further rotation of adjustment knob 2 to align position aperture 36 with index notch 29A, gas port 34 is positioned in communication with gas port aperture 18 which allows an optimal flow of discharge gas 27 to cycle the host firearm without a silencer and under normal conditions. With further rotation of adjustment knob 2 to align position aperture 36 with index notch 29B, gas port 35 is positioned in communication with gas port aperture 18 which allows an extra flow of discharge gas 27 to cycle the host firearm without a silencer and under adverse conditions. Lastly a further rotation of adjustment knob 2 to align position aperture 36 with index notch 29C takes gas port 33, 34 and 35 out of communication with gas port aperture 18 shutting off the flow of discharge gas 27 to the host firearm operation system. Although the presently disclosed multi-block gas regulator is disclosed to have four distinct gas settings, it is envisioned that two or more gas settings may be provided, e.g., three, four, five, six, etc.

Referring to FIGS. 1, 3, and 7, the rotational position of regulating cylinder 5A within gas block 6A, and thus the gas settings, are maintained by an interlocking mechanism defined by the four index notches 29-29C of bushing 3 and adjustment knob's 2 two position stops 28. Pulling muzzleward on the adjustment knob 2 moves adjustment knob 2 muzzleward against the urging of spring 1 to release the position stops 28 from the index notches 29-29C allowing rotation of the regulating cylinder 5A, thus changing the gas setting. Aligning the position aperture 36 with any one of the index notches 29-29C and releasing the adjustment knob 2 again interlocks the position stops 28 within the index notches 29-29C preventing rotation of the regulating cylinder 5A, thus securing the selected gas setting. More specifically, when position aperture 36 is aligned with a selected index notch 29-29C by rotating adjustment knob 2 and, thereafter, released, spring 1 urges adjustment knob 2 towards bushing 3 to locate position stops 28 into selected index notches 29-29C to releasably lock adjustment knob 2 and regulating cylinder 5A at a rotatably fixed position. Because regulating cylinder 5A is rotatably fixed to adjustment knob 2 by split-pins 4, regulating cylinder 5A is maintained in a rotatably fixed position within gas block 6A, 6B.

Referring to FIG. 4, low profile gas block 6B is configured with four index notches 29-29C, which correspond to the index notches on bushing 3. The adjustment knob 2 and position stops 28 of adjustment knob 2 interface with the four index notches 29-29C of the low profile gas block 6B in the same way the notches 29-29C of bushing 3 interface with the position stops 28 of adjustment knob 2 to provide the same means for selectively adjusting and maintaining the gas settings.

Figure 8:
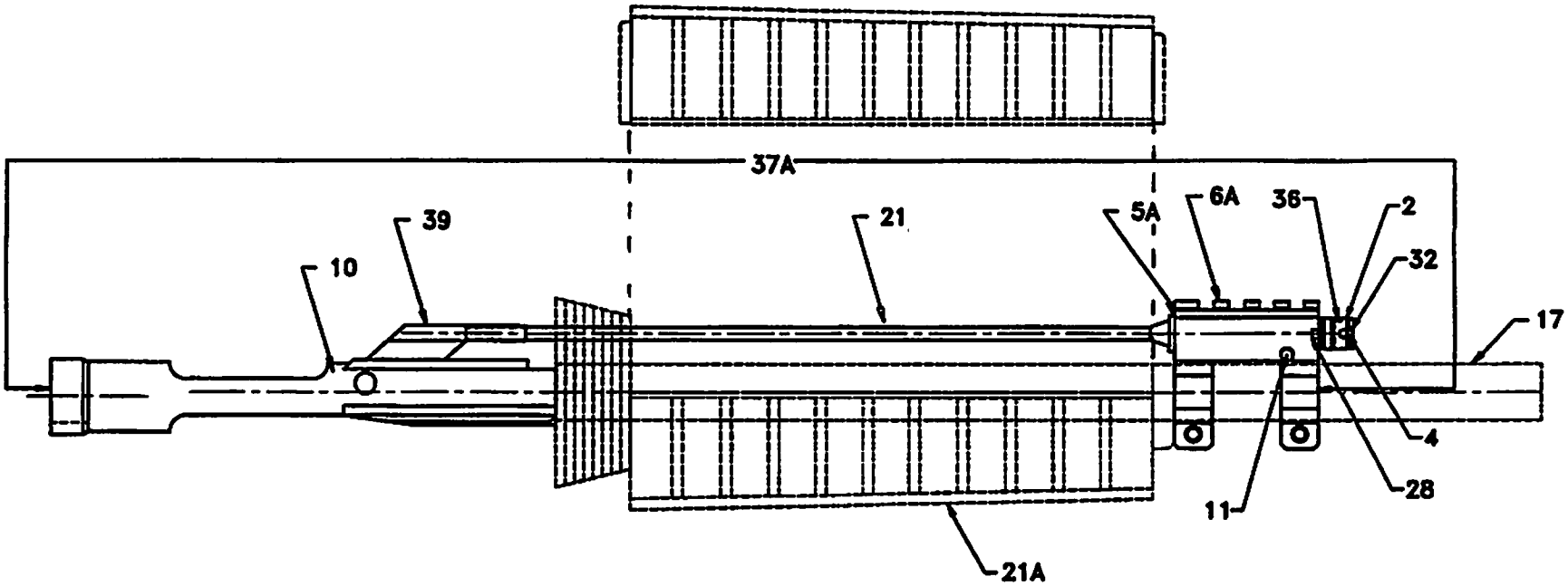
FIG. 8 is a side view of the presently disclosed multi-block gas regulator shown in FIG. 1, illustrating how the Picatinny type gas block with removable four position gas regulating cylinder shown in FIG. 1 can be configured with a gas tube so as to be utilized by a direct gas impingement firearm.
Figure 9:
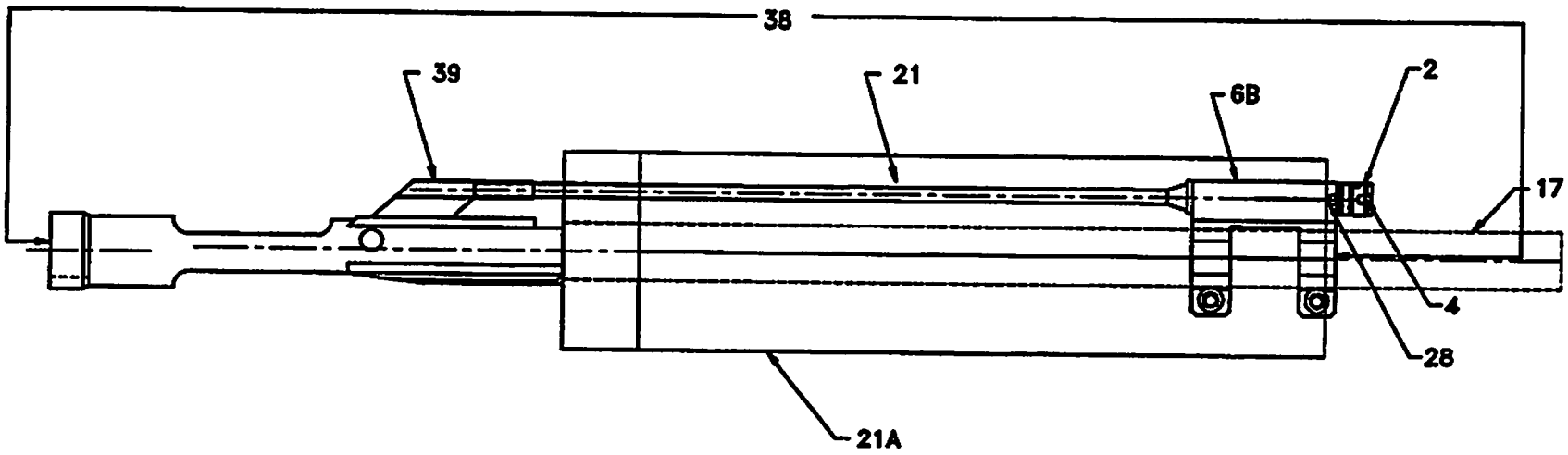
FIG. 9 is a side view of the presently disclosed multi-block gas regulator illustrating how the low profile gas block with four position gas regulating cylinder shown in FIG. 2 can be configured with a gas tube so as to be utilized by a direct gas impingement firearm.

Referring to FIGS. 8 and 9, the multi-block gas regulator may be configured with a gas tube 21 for utilization with a direct gas impingement operating system, e.g. AR-15/AR-10 family of firearms. More specifically, in FIGS. 8 and 9, the piston 7, op-rod 8 and return spring 9 in FIG. 5 are replaced by a gas tube 21. Referring to FIGS. 5, 7, 8, and 9, the multi-block gas regulator 37 and 38 directs discharge gas 27 through the regulating cylinder 5A to act upon a piston 7 causing the firearm's action to cycle. In comparison the multi-block gas regulator 37A and 38A in FIGS. 8 and 9 directs discharge gas 27 through the regulating cylinder 5A and gas tube 21 into a bolt carrier gas key 39 causing the firearm's action to cycle. Otherwise all the operational characteristic of the multi-block gas regulator 37, 38 and the gas tube configured multi-block gas regulator 37A 38A are identical.

Persons skilled in the art will understand that the devices and methods specifically described herein and illustrated in the accompanying drawings are non-limiting exemplary embodiments. It is envisioned that the elements and features illustrated or described in connection with one exemplarly embodiment may be combined with the elements and features of another without departing from the scope of the present disclosure. As well, one skilled in the art will appreciate further features and advantages of the system based on the above-described embodiments. Accordingly, the present disclosure is not to be limited by what has been particularly shown and described, except as indicated by the appended claims.

What is claimed is:

1. An adjustable gas regulator for use with a gas operated firearm, the adjustable gas regulator comprising:

a gas block configured to receive a barrel of a firearm and defining a gas block bore;

a gas port defined within the gas block bore, the gas port being positioned to communicate with a gas port aperture of a firearm;

a gas regulating cylinder dimensioned to be rotatably received within the gas block bore, the gas regulating cylinder defining a plurality of cylinder gas ports of different sizes spaced about the periphery of the gas regulating cylinder, wherein the gas regulating cylinder is rotatably positioned within the gas block bore such that the gas regulating cylinder is rotatable to selectively position any one of the cylinder gas ports in communication with the gas port of the gas block bore; and an adjustment knob secured to one end of the gas regulating cylinder, the adjustment knob being rotatably fixed in relation to the gas regulating cylinder such that rotation of the adjustment knob effects corresponding rotation of the gas regulating cylinder, the adjustment knob including interlocking structure to releasably retain the adjustment knob in a plurality of fixed positions in relation to the gas block, wherein the adjustment knob is movable axially using a single hand to selectively disengage the interlocking structure to facilitate rotation of the adjustment knob and the gas regulating cylinder.

2. An adjustable gas regulator for use with a gas operated firearm, the adjustable gas regulator comprising:

a gas block configured to receive a barrel of a firearm and defining a gas block bore;

a gas port defined within the gas block bore, the gas port being positioned to communicate with a gas port aperture of a firearm;

a gas regulating cylinder dimensioned to be rotatably received within the gas block bore, the gas regulating cylinder defining a plurality of cylinder gas ports of different sizes spaced about the periphery of the gas regulating cylinder, wherein the gas regulating cylinder is rotatably positioned within the gas block bore such that the gas regulating cylinder is rotatable to selectively position any one of the cylinder gas ports in communication with the gas port of the gas block bore; and an adjustment knob secured to one end of the gas regulating cylinder, the adjustment knob being rotatably fixed in relation to the gas regulating cylinder such that rotation of the adjustment knob effects corresponding rotation of the gas regulating cylinder, the adjustment knob including interlocking structure configured to releasably retain the adjustment knob in one of a plurality of rotatably fixed positions in relation to the gas block;

wherein the adjustment knob includes at least one position stop and the gas block supports structure defining a plurality of notches dimensioned to receive the at least one position stop to rotatably maintain the adjustment knob and the gas regulating cylinder in rotatably fixed positions with respect to the gas block.

3. The adjustable gas regulator according to claim 2, wherein the adjustment knob is movable axially from a first position wherein the at least one position stop is received in at least one of the plurality of notches to a second position wherein the at least one position stop is disengaged from the at least one of the plurality of notches, wherein in the second position of the adjustment knob, the adjustment knob and the gas regulating cylinder are rotatable in relation to the gas block.

4. The adjustable gas regulator according to claim 3, further including a spring positioned to urge the adjustment knob to the first position.

5. The adjustable gas regulator according to claim 4, further including a bushing fixedly positioned within the gas block bore.

6. The adjustable gas regulator according to claim 5, wherein the plurality of notches are formed in one end of the bushing.

7. The adjustable gas regulator according to claim 5, wherein the plurality of notches are formed in one end of the gas block.

8. The adjustable gas regulator according to claim 3, wherein the plurality of notches includes four notches and the at least one position stop includes two position stops.

9. The adjustable gas regulator according to claim 8, wherein each of the plurality of notches is spaced 90 degrees from an adjacent notch.

10. The adjustable gas regulator according to claim 1, wherein the gas block is a Picatinny-type gas block.

11. The adjustable gas regulator according to claim 1, wherein the gas regulating cylinder defines a piston bore which is positioned to receive the piston of an operating system of a firearm, the piston bore being positioned externally of the gas block bore.

12. The adjustable gas block regulator according to claim 1, wherein the adjustment knob is configured and dimensioned to be positioned forwardly of a hand guard of a firearm to facilitate single handed manipulation of the adjustment knob using either hand.

13. The adjustable gas block regulator according to claim 4, wherein the adjustment knob is configured and dimensioned to be positioned forwardly of a hand guard of a firearm to facilitate single handed manipulation of the adjustment knob using either hand.

14. An adjustable gas block regulator for use with a gas operated firearm, the adjustable gas regulator comprising:

a gas block configured to receive a barrel of a firearm and defining a gas block bore;

a gas port defined within the gas block bore, the gas port being positioned to communicate with a gas port aperture of a firearm;

a gas regulating cylinder dimensioned to be rotatably received within the gas block bore, the gas regulating cylinder defining a plurality of cylinder gas ports of different sizes spaced about the periphery of the gas regulating cylinder, wherein the gas regulating cylinder is rotatably positioned within the gas block bore to selectively position any one of the cylinder gas ports in communication with the as port of the gas block bore within the gas block bore by a retaining pin which is positioned to prevent axial movement of the gas regulating cylinder within the gas block bore;

the plurality of gas ports being spaced uniformly about the gas regulating cylinder such that the gas regulating cylinder is rotatable within the gas block bore of the gas block 360 degrees to position any one of the cylinder gas ports in communication with the gas port of the gas block bore or to shut off flow of discharge gas from the firearm; and a bushing positioned in the gas block bore, the bushing including a groove for receiving the retaining pin to axially fix the bushing and the gas regulating cylinder within the gas block bore.

15. The adjustable gas block regulator according to claim 14, further including an adjustment knob secured to one end of the gas regulating cylinder, the adjustment knob being rotatably fixed in relation to the gas regulating cylinder such that rotation of the adjustment knob effects corresponding rotation of the gas regulating cylinder.

16. The adjustable gas block regulator according to claim 15, wherein the adjustment knob and the bushing include interlocking structure configured to releasably retain the adjustment knob in one of a plurality of rotatably fixed positions in relation to the gas block.

17. The adjustable gas block regulator according to claim 16, wherein the adjustment knob includes at least one position stop and the bushing defines a plurality of notches dimensioned to receive the at least one position stop to rotatably maintain the adjustment knob and the gas regulating cylinder in rotatably fixed positions with respect to the gas block.

18. The adjustable gas block regulator according to claim 14, wherein the plurality of gas ports includes three gas ports, each of the plurality of gas ports being spaced 90 degrees from an adjacent gas port.

* * * * *